US006561197B2

(12) United States Patent
Harrison

(10) Patent No.: US 6,561,197 B2
(45) Date of Patent: May 13, 2003

(54) HAIR INTEGRATION SYSTEM AND METHOD OF ATTACHMENT

(75) Inventor: Dawn P. Harrison, Vista, CA (US)

(73) Assignee: Hair Addition Studio, Inc., Vista, CA (US)

( * ) Notice: Subject to any disclaimer, the term of this patent is extended or adjusted under 35 U.S.C. 154(b) by 0 days.

(21) Appl. No.: 09/836,918

(22) Filed: Apr. 18, 2001

(65) Prior Publication Data

US 2002/0179108 A1 Dec. 5, 2002

(51) Int. Cl.[7] ..... A41G 3/00; A41G 5/00; A45D 7/06

(52) U.S. Cl. ..... 132/201; 132/207; 132/53

(58) Field of Search ..... 132/201, 53, 56, 132/55, 54, 207

(56) References Cited

U.S. PATENT DOCUMENTS 3,307,563 A * 3/1967 Regina ..... 132/201
3,447,541 A * 6/1969 Golden ..... 132/53
3,645,279 A * 2/1972 Imre ..... 132/53
3,830,245 A * 8/1974 Abbott et al. ..... 132/53
4,171,001 A * 10/1979 Leonard et al. ..... 132/53
4,658,841 A * 4/1987 Won ..... 132/53
4,784,713 A 11/1988 Van Nieulande
5,406,971 A * 4/1995 Taylor ..... 132/201
5,493,735 A * 2/1996 Rice ..... 2/209.13
5,853,008 A * 12/1998 Nelson ..... 132/53
6,035,861 A 3/2000 Copello

* cited by examiner

*Primary Examiner*—John J. Wilson
*Assistant Examiner*—Robyn Kim Doan
(74) *Attorney, Agent, or Firm*—Brown Martin Haller & McClain LLP

(57) ABSTRACT

A hair integration apparatus and method of attachment thereof is provided. The hair integration apparatus is comprised of a cap-like base that has numerous spaced, hair pull-through openings located on its side and rear faces. The hair integration is attached to a wearer's scalp when a continuous band of material contained around the perimeter of the cap is adhered to the wearer's head. The top face of the cap does not contain any hair pull-through openings and is instead made of a breathable material to allow for the release of heat from the wearer's body.

4 Claims, 2 Drawing Sheets

HAIR INTEGRATION SYSTEM AND METHOD OF ATTACHMENT

BACKGROUND OF THE INVENTION

This invention relates to an improved hair integration system and method of attaching such system to a wearer's head.

Various hair systems have been available that replicate hair and are worn with those that have thinning hair or no hair at all. Some systems use human hair while others use synthetic hair. The human hair systems generally utilize European or Indian hair because it is the finest hair available. The advantage to using human hair is that no man made material can duplicate the feel or naturalness of human hair. Additionally, the human hair can be easily permed, blow dried, or styled to suit each individual. The disadvantage with using human hair is that oxidation may occur after a period of time and the hair may need to be recolored periodically. On the other hand, synthetic hair fades in color more slowly and recoloring is not necessary. Additionally, it has memory and can be pre-styled to customize each individual's preferences and it tangles less easily.

Previous hair systems have been attached to the head by various methods. Bonding is the most permanent type of attachment and is done with adhesive applied to the hair system. Bonding is the most secure method of attaching the hair system to the scalp. The bonding material is usually some kind of glue or medical adhesive, and is applied to the perimeter on the base of the hair system and then attached to the scalp. With this type of bonding, most people can shower and swim without having to take the hair system off for an extended period of time. However, the major drawback is that the hair system will become loose after about four to six weeks. This means that periodic visits to the hair replacement studio are necessary for the wearer to have the scalp cleansed and to have new bonding material reapplied to the hair system. Additionally, the life of the hair system tends to be shorter.

Taping is another form of attaching hair systems. It is the most convenient method available. Taping allows for frequent cleaning of the scalp and also prolongs the life of the unit. Many tapes available are waterproof so that a person may participate in sports or go swimming without having to worry about the hair system coming off. Additionally, tape can be a very secure method of attachment of hair pieces.

Finally, clips are another method of attachment of hair pieces. With this method, tiny clips are sewn into the perimeter of the hair system. The hair system is then clipped into a person's existing hair to facilitate the attachment. While this type of attachment can be quite secure, the major drawback is that the clips are very uncomfortable.

The problem with the previous hair attachment systems is that none of them combined the ability to integrate a person's existing hair with a system that allowed for attachment to a person's scalp. Integration systems have traditionally involved hair pieces that utilized crochet cap-like matrixes with openings. The openings allowed for hair to be drawn through them in order to add more hair onto the person's existing hair. The crochet material was often made of thread or fabric material which was not comfortable for the wearer. Additionally, these systems generally required the integrated hair to be attached to a person's existing hair. This is problematic because the integrated hair grows out as the person's hair grows out and the integrations become visible. This is not aesthetically appealing and additionally, as the person's hair grows out, the integration becomes less secure and shifts out of the originally secured position.

Therefore, there is a need for a hair system that securely attaches to a person's head so that regrowth is not a problem and also integrates the person's hair into the system.

SUMMARY OF THE INVENTION

It is an object of the present invention to provide a new and improved hair integration system and method of attachment thereof.

According to one aspect of the invention, a hair integration apparatus is provided. The apparatus is comprised of a cap-like matrix of a predetermined shape that fits over a person's head, multiple hair pull-through openings across at least part of the area of the matrix, and a plurality of hair strands secured to the cap and extending therefrom in order to imitate naturally growing hair. The cap has an inner surface and an outer surface and has multiple openings positioned across at least part of the entire area. The cap is formed of two separate areas or regions. The first region corresponds to the region of a person's head at the front of the head adjacent to the brow. This region of the cap is comprised of breathable monofilament mesh material that contains holes that are large enough to allow moisture to escape. The monofilament material is water permeable and allows moisture to escape from the top of the wearer's head through the material, however, the monofilament nylon material contains no pull-through openings. The second region of the cap extends from the first region down to the perimeter of the cap. This second region is comprised of breathable material that is stretchable and is able to be attached to a person's scalp. The material is artificial man-made skin such as that manufactured by New Concepts of Florida, U.S.A. Around the periphery of the second region of the cap is a continuous band of the material. This band extends around the entire bottom perimeter of the cap and is used to adhere the cap to the user's head.

The cap has an upper portion, opposite side portions, and a rear portion. Each portion covers the corresponding portions of the wearer's head. The upper portion is the one that is made of the monofilament material but does not contain any pull-through openings. The opposite side portions contain at least some openings that are generally parallel slots that extend in a direction from the front to the rear of the cap. Additionally, the rear portion of the cap also contains some openings that are configured in the same manner as those of the side portions. The openings in each of the side portions extend over a generally triangular area having a base that is adjacent to the upper portion of the cap with the apex of the triangle adjacent to the perimeter of the cap. The openings for the hair pull-through are generally decreasing in length from the base of the triangle area to the apex. Additionally, the openings in the rear portion of the cap extend over a generally triangular area. The area has its base adjacent to the perimeter of the cap and the apex adjacent to the upper portion of the cap in a manner that is oriented opposite from that of the sides of the cap. The openings in the rear portion of the cap extend over a generally triangular area having a base adjacent to the perimeter of the cap and an apex adjacent to the upper portion of the cap. The openings comprise a stack of slots that extend parallel to one another and also to the base of the triangular area. The slots are of gradually decreasing dimensions from the base to the apex of the rear triangular area. The cap also has a front flap that extends from the perimeter of the cap at the region that corresponds to the brow of a wearer's head. A portion of the front flap projecting a short distance from the perimeter has hair attached to it. The remainder has no hair attached and is instead intended to be used by a user to grip the cap while positioning it onto the wearer's head. Once the cap has been positioned and bonded onto the wearer's head, the forward portion of front flap is then clipped off up to the hair covered portion in order to be removed from the cap. The unattached front portion of the flap provides for a very natural look to the integrated system.

One advantage of the present embodiment described herein is that because the hair system is attached to the wearer's scalp and not to the existing hair, when the existing hair grows out, there is no fear of the integration slipping out of place. Additionally, because present integration system is formed from the cap base that stretches around the person's head, the fit is more natural looking. There is no fear of the integration slipping or growing out as in the prior systems. Also, because the cap is not formed of crochet thread or fabric material, it is more comfortable on the wearer's head. The cap of the hair integration, when attached to the scalp and with the hair integrated with the wearer's hair, will be substantially invisible.

Because the entire system is intended to be used as an integrated system with the user's own hair, the present system is uniquely designed with various combinations of hair color blended within each system. The system may have three to eight different shades blended in different proportions in different areas of the cap, so that the added hair blends naturally and more or less invisibly with the wearer's own hair. The color of the hair does not have to be all the same and therefore multiple colors are used together in various combinations in order to provide for a look that is more natural.

According to another aspect of the present invention, a method of attaching a hair integration device to a wearer's head is provided, which first begins with the step of placing a hair integration device over at least a portion of the wearer's head to which additional hair is to be added. The hair integration device comprises a base and a plurality of hair strands attached to extend from an outer surface of the base. At least a portion of the base comprises stretchable material. An example of such material is the artificial man-made skin manufactured by New Concepts of Florida, U.S.A. Another portion of the cap is made of monofilament mesh that is a breathable material so that body heat is allowed to escape from a person's body that is wearing the cap. An example of this material is monofilament nylon mesh breathable fabric also manufactured by New Concepts. A line is drawn on the wearer's scalp that corresponds with to the perimeter of the base in order to align the base for positioning onto the wearer's head and then the hair integration device is removed from the wearer's head. Then a layer of adhesive is applied to at least part of the inner surface of the base for the first layer of adhesive. A second layer of adhesive is then applied in the form of a tape strip onto the adhesive layer. Then a layer of grafting solution is applied to the tape strip and a layer of grafting solution is also applied to the line marked area of the wearer's scalp. After all of the adhesive layers have been applied, the inner surface of the base is pressed to the line marked area of the wearer's scalp so that the base becomes grafted to the wearer's scalp, and then the wearer's hair is integrated with the hair attached to the base. An example of the layer of the adhesive applied first to the inner surface of the base is "Be Sure Dab on" adhesive manufactured by Premier Products of California, U.S.A. An example of the tape strip is "Red Liner Tape" manufactured by Walker Tape Company of Utah, U.S.A. and an example of the grafting solution is "Max Grafting Solution" manufactured by Cohesive Solutions of California, U.S.A.

According to a final aspect of the present invention, a method of integrating a person's natural hair with hair attached to a hair integration device is provided. First, a cap is positioned over a wearer's head to cover the wearer's natural hair and extend at least a short distance beyond the hairline at the front of the head or brow. The cap covers at least part of the wearer's natural hair but terminates short of the hairline at the sides and rear of the head. The cap has opposite inner and outer surfaces, a perimeter, and a plurality of spaced, pull-through openings extending across at least part of the area of the cap. The cap also has multiple hair strands attached to the outer surface of the cap. At least the perimeter of the cap is secured to the wearer's head, adjacent to the hairline. Securing the cap is performed by first marking the position of the perimeter of the cap on the wearer's head. Then the cap is removed and grafting material is applied around the perimeter of the inner surface of the cap and in a narrow strip around the marked region of the wearer's head. Then the cap is repositioned over the wearer's head and the perimeter of the cap is pressed against the grafting material layer on the wearer's head to secure the cap in position over the head. After the cap has been secured, then portions of the wearer's natural hair are pulled through the hair pull-through openings and integrated with the natural hair of the wearer and with the hair attached to the cap.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
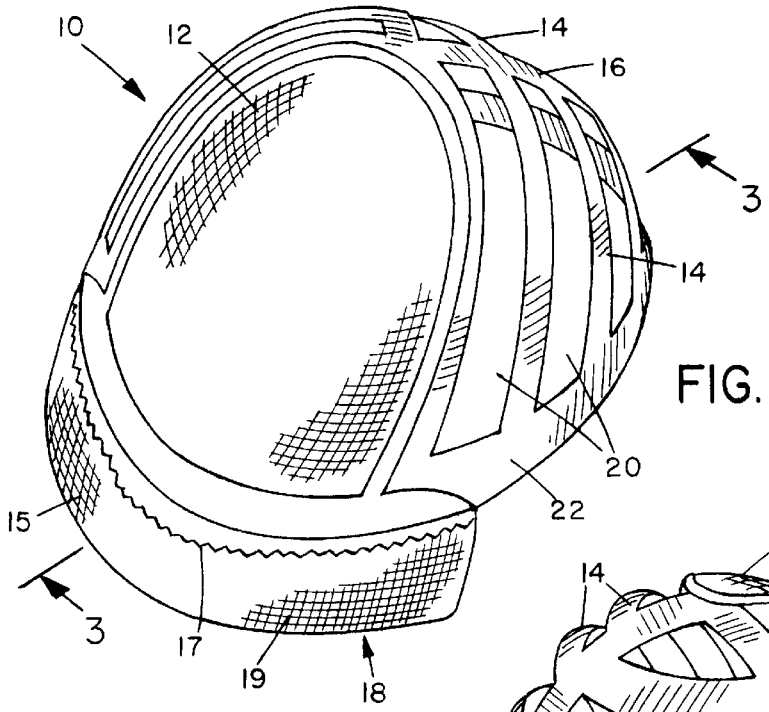
FIG. 1 is a front perspective view of the cap portion of the hair integration apparatus.

FIG. 1 illustrates a perspective view of the front cap portion of a hair integration device 10 according to an exemplary embodiment of the present invention. The hair integration device is comprised of a cap 10 of predetermined shape for covering a portion of the wearer's head extending from the brow rearwardly and to the sides. The cap 10 has an upper portion 12, opposite side portions 14, and a rear portion 16 for covering corresponding portions of a wearer's head. The dimensions of the cap are such that the perimeter is spaced inwardly from the natural hairline at the sides and rear of the head, and slightly forward of the hairline at the brow. The upper portion 12 of the cap is made of monofilament nylon mesh breathable fabric that does not contain any hair pull-through openings. This particular type of fabric is contained on the upper portion of the cap so that heat and moisture can escape from the top of the wearer's head through the material. The material covers the upper portion 12 of the cap 10 and also protrudes to form a front flap 18 that extends from the perimeter of the cap 10 corresponding to the brow of the wearer's head. This front flap 18 has a first portion or "lace front" 15 which extends up to a zig-zag, sewn line 17 on the flap. This portion has hair attached (see FIG. 4). The remainder or forward portion 19 has no attached hair (see FIGS. 4 and 5), and is intended to be used by a user for gripping while adhering the cap 10 to a wearer's head. Once the cap 10 is secured to the wearer's head, the forward portion 19 of the front flap 18 is removed.

Figure 2:
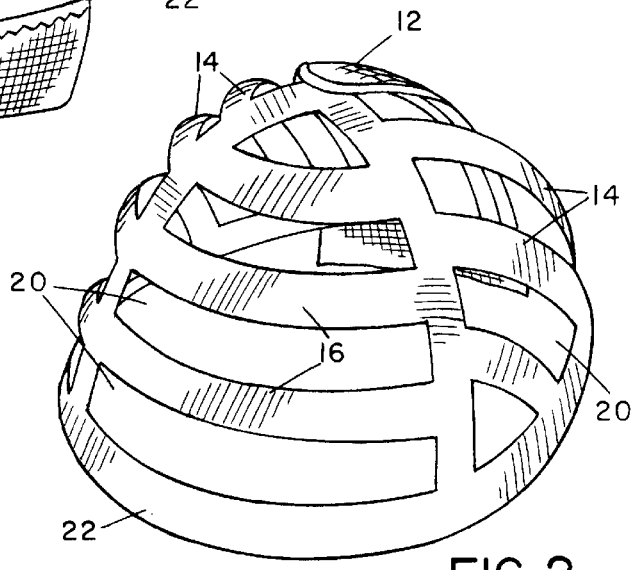
FIG. 2 is a rear perspective view of the cap portion of the hair integration apparatus.

FIG. 2 illustrates a perspective view of the back cap portion 16 of a hair integration device according to an exemplary embodiment of the present invention. The rear portion 16 and the opposite side portions 14 of the cap 10 contain hair pull-through openings 20 that extend over a predetermined pattern. The openings 20 of the rear portion 16 extend over a generally triangular area having a base adjacent to the perimeter 22 of the cap 10 and an apex adjacent to the upper portion 12 of the cap 10. The openings comprise a stack of slots extending parallel to one another and to the base of the triangular area. The openings 20 of the opposite side portions 14 extend over a generally triangular area having a base adjacent to the upper portion 12 of the cap 10 and an apex adjacent to the perimeter 22 of the cap. The openings 20 of the side portions 14 are of gradually decreasing length from the base to the apex of the triangular area in an opposite manner to the triangular area of the rear portion 16 of the cap 10.

Figure 3:
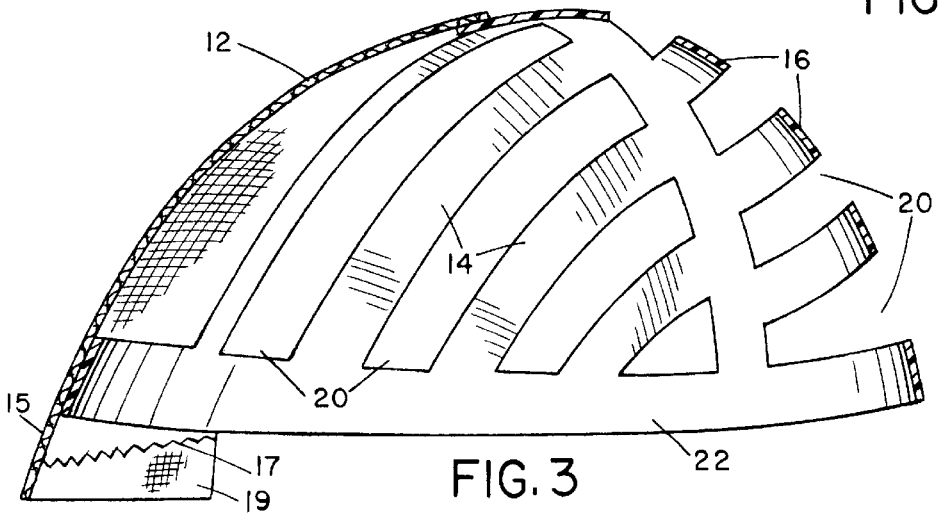
FIG. 3 is an enlarged sectional view taken on line 3—3 of FIG.

FIG. 3 is a sectional view taken on line 3—3 of FIG. 1 and illustrates the cap 10 and all of its portions. The upper portion 12 of the cap 10 and the front flap 18 that extends from the cap 10 are made from the monofilament nylon material. The side portions 14 are generally triangular in shape and contain hair pull-through openings 20. The rear portion 16 of the cap is also of a general triangular shape. However, the triangular area of the rear portion is oriented in the opposite direction as the triangular areas of the opposing side portions 14. Both the side portions 14 and the rear portion 16 have hair pull-through openings 20 that comprise a stack of slots that extend parallel to one another.

Figure 4:
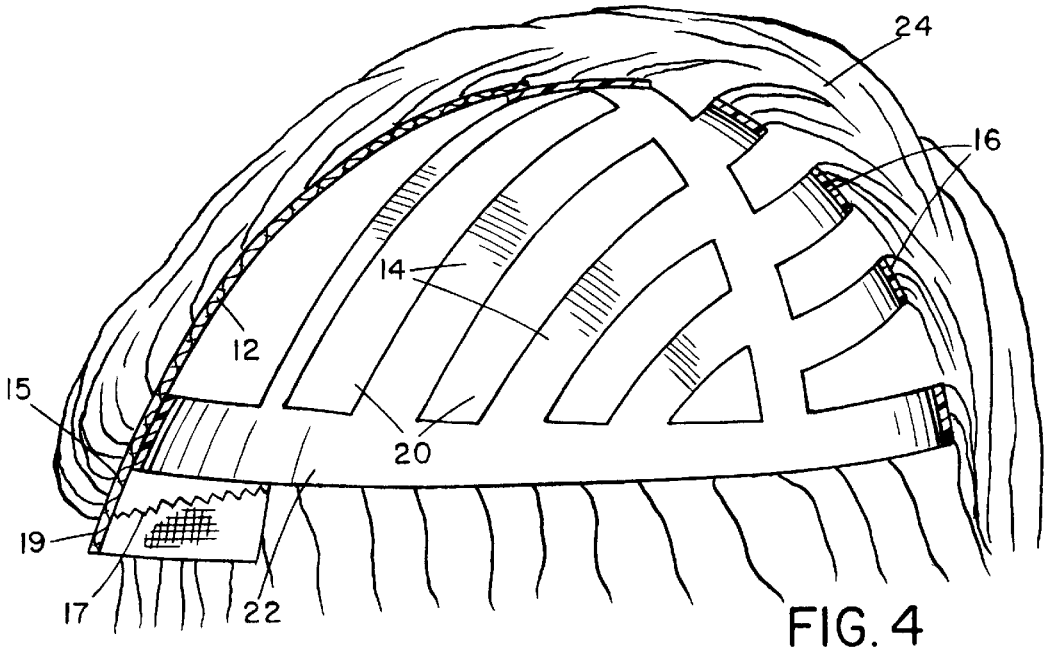
FIGS. 4 and 5 are views similar to the sectional view as FIG. 3, illustrating the successive steps in a method of attaching the hair integration device to a wearer's head.
Figure 5:
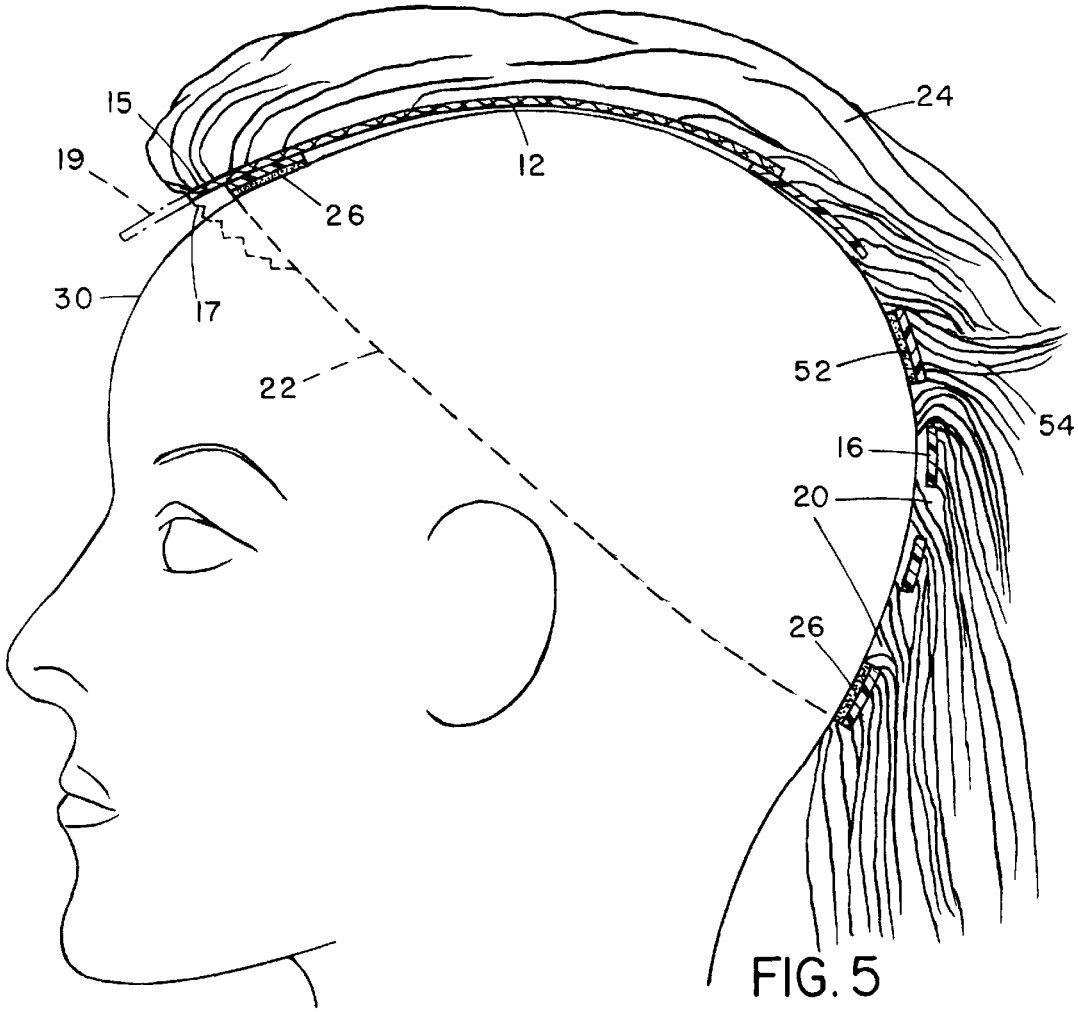

FIGS. 1 to 3 illustrate the cap of the hair integration device without the attached hair, for clarity. As illustrated in FIGS. 4 and 5, hair strands 24 are attached to the outer surface of the cap to extend over the upper mesh portion 12, the forward portion or lace front 15 of the flap 18, and over the entire surface of the bands separating the openings 20 in the rear and side portions. These strands extend from the cap 10 in order to imitate naturally growing hair. The hair strands may be of any desired color, depending on the wearer's own natural hair color. In an exemplary embodiment, a blend of different hair colors are used so as to produce a more natural appearance. Between three to eight different hair colors is used in each hair integration device, with different proportions of the different colors being used in different areas of the cap. One or two basic colors or medium shades will be used, with one or more lighter shades and one or more darker shades blended with the basic shades. The front or upper portion 12 is provided with the lightest blend of colors, with the sides and rear having gradually darker blends for a natural effect. The cap will be divided into six different areas with different blends of color: a front area, a top area, left and right temple areas, left and right side areas, a crown area, and a back area. Some of these areas may have the same blend of hair colors, or they may all have slightly different blends. One example is given in the following table, where the different numbers correspond to different hair dye colors:

| HAIR COLOR | FRONT | TOP | TEMPLES | | SIDES | | CROWN | BACK |
|---|---|---|---|---|---|---|---|---|
| Warm Blonde w/ highlights | 14/24 | 14/24 | L 12 | R 12 | L 12 | R 12 | 12 | 8 |
| Low-lite | 12 40% | 12 50% | 10/16 20% | 10/16 20% | 10/16 20% | 10/16 20% | 10/16 20% | 10/16 20% |
| Hi-lite | % | % | 14/24 30% | 14/24 30% | 8 40% | 8 40% | 14/24 20% | % |

It has been found that the blending of strands of hair of varying colors in varying proportions over the area of the cap produces a much more natural effect, such that the added hair is essentially invisible and cannot be distinguished from the wearer's own natural hair. The provision of openings in the cap through which the wearer's hair is pulled and blended with the added hair further aids in the natural appearance and makes the device much more comfortable and easy to wear over extended periods of time.

Figure 6:
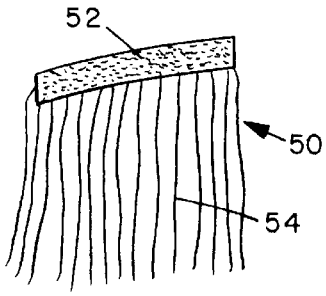
FIG. 6 is a rear view of a repair or add-on strip for the apparatus.

FIG. 6 illustrates an optional add-on or repair strip 50 for use with the hair integration device 10. Strip 50 comprises a layer 52 of breathable, stretchable skin material with hair strands 54 attached to extend from one side of the strip. This strip 50 can be used to repair the device 10, for example if one of the bands separating the openings 20 should break. The strip 50 can then be grafted directly to the wearer's scalp in the appropriate location, or may be bonded to the remainder of the cap after removing the broken band. Additionally, the strip 50 may be used as an add-on at the rear of the cap if more coverage is required, for example forwearers having larger heads. Of course, the cap itself may be made in several sizes, equivalent to hat sizes, to accommodate different head sizes, although the stretchable material of the rear and sides of the cap make it adaptable for some variation in head size and coverage.

The method of attaching the hair integration device to a wearer's head will now be described. As described above, the hair integration device 10 is placed over at least a portion of a wearer's head using the front portion 19 of the flap to position the front of the cap adjacent the wearers hairline at the brow. Then a line is drawn on the wearer's scalp 30 that corresponds with the perimeter 22 of the base. The hair integration device 10 is then removed and layers of adhesive, tape and grafting solution 26 are applied to the inner surface of the cap in a layer or band around the perimeter 22. A layer of grafting solution is also applied to the scalp 30 of the wearer along the marked line. Then the inner surface of the hair integration device 10 is pressed to the line marked area of the wearer's scalp 30 around the perimeter so that the perimeter becomes grafted to the wearer's scalp 30. Finally, the wearer's own hair is integrated with the hair integration device 10 when the wearer's hair is pulled through the openings 20 of the device, and the front portion 19 of the flap 18 is removed.

The hair integration system and method of this invention produces a much more natural enhancement of the wearer's existing hair. It is fully integrated with the hair and the cap will be essentially invisible to an observer when properly installed. The hair integration can be worn for six to eight weeks at a time without requiring re-attachment, which is at least two weeks longer than currently known hair piece bonding methods.

Although an exemplary embodiment of the invention has been described above by way of example only, it will be understood by those skilled in the field that modifications may be made to the disclosed embodiment without departing from the scope of the invention, which is defined by the appended claims.

I claim:

1. A method of attaching a hair integration device to a wearer's head, comprising the steps of:

placing a hair integration device comprising a layer of stretchable skin-like material having an arcuate inner surface to lay flat against the head over at least a portion of a wearer's head to which additional hair is to be added, the hair integration device comprising a base including at least a portion of stretchable material and a plurality of hair strands attached to extend from an outer surface of the base;

drawing a line on the wearer's scalp corresponding to the perimeter of the base;

removing the hair integration device from the wearer's head;

applying a layer of adhesive to at least part of the inner surface of the base;

applying a tape strip onto the adhesive layer;

applying a layer of grafting solution to the tape strip;

applying a layer of the grafting solution to the line marked area of the wearer's scalp;

pressing the inner surface of the base to line marked area of the wearer's scalp so that the base becomes grafted to the wearer's scalp; and integrating the wearer's hair with the hair attached to the base.

2. A method of integrating a person's natural hair with hair attached to a hair integration device, comprising the steps of:

taking a cap comprised of skin-like stretchable material having an arcuate inner surface to lay flat against the head, opposite inner and outer surfaces, a perimeter, a plurality of spaced, hair pull-through openings extending across at least part of the area of the cap, and a plurality of hair strands attached to the outer surface of the cap;

positioning the cap over a wearer's head to cover at least part of the wearer's natural hair and extend at least a short distance beyond the hairline at the front of the head;

securing at least the perimeter of the cap to the wearer's head adjacent the hairline; and pulling portions of the wearer's natural hair through the hair pull-through openings and integrating the natural hair with the hair attached to the cap.

3. The method as claimed in claim 2, wherein the step of securing the cap to the wearer's head comprises marking the position of the perimeter of the cap on the wearer's head, removing the cap from the head, applying bonding material at least around the perimeter of the inner surface of the cap and in a narrow strip around the marked region of the wearer's head, repositioning the cap over the wearer's head, and pressing the perimeter of the cap against the grafting material layer on the wearer's head to secure the cap in position over the head.

4. The method as claimed in claim 2, wherein the step of securing the cap to the wearer's head includes leaving a forwardly projecting flap at the front of the head unsecured to the head, the forwardly projecting flap having a first portion with hair attached adjacent the secured perimeter of the cap, and a second portion with no attached hair for use in positioning the cap, and further including the step of removing the second portion of the flap after the cap is secured.

* * * * *